US005328791A

United States Patent [19]

Ohta

[11] Patent Number: 5,328,791

[45] Date of Patent: Jul. 12, 1994

[54] DRY TYPE DEVELOPER UTILIZED IN IMAGE RECORDING APPARATUS

[75] Inventor: Mitsuru Ohta, Nagoya, Japan

[73] Assignee: Brother Kogyo Kabushiki Kaisha, Nagoya, Japan

[21] Appl. No.: 986,802

[22] Filed: Dec. 8, 1992

[30] Foreign Application Priority Data

Dec. 10, 1991 [JP] Japan ..... 3-325893

[51] Int. Cl.[5] ..... G03G 9/08

[52] U.S. Cl. ..... 430/106; 430/111

[58] Field of Search ..... 430/106, 106.6, 109, 430/110, 111

[56] References Cited

U.S. PATENT DOCUMENTS 3,689,935 9/1972 Pressman et al. ..... 346/74
4,996,126 2/1991 Anno et al. ..... 430/106.6
5,137,796 8/1992 Takiguchi et al. ..... 430/111
5,202,213 4/1993 Nakahara et al. ..... 430/111

FOREIGN PATENT DOCUMENTS 57-102666 6/1982 Japan .
63-304002 12/1988 Japan .

*Primary Examiner*—John Goodrow
*Attorney, Agent, or Firm*—Kane, Dalsimer, Sullivan, Kurucz, Levy, Eisele and Richard

[57] ABSTRACT

Disclosed is a dry type developer including colored particles which are flown to a recording medium, thereby an image being recorded on the recording medium, wherein, a ratio of both an average particle size of the particles calculated based on volume of the particle and an average particle size of the particles calculated based on number of the particle, lies in a range of from 1.00 to 1.35. Thereby, the distribution of the particle size in the toner can be made sharp with mono-dispersion, thus uniform charge quantity can be obtained without being affected by changing in the charge quantity changed according to the toner particle size, because the toner particle size can be made uniform. Therefore, the image with stable and uniform concentration can be recorded on the recording medium all the time. As a result, the image with fine line can be clearly recorded on the recording medium with high resolution.

20 Claims, 2 Drawing Sheets

DRY TYPE DEVELOPER UTILIZED IN IMAGE RECORDING APPARATUS

BACKGROUND OF THE INVENTION

1. Field of the Invention

The present invention relates to a dry type developer utilized in an image recording apparatus such as a copy machine, a printer, and particularly to a dry type developer utilized in an image recording apparatus in which an aperture electrode with a plurality of apertures is installed and an image is directly recorded on a recording medium by controlling whether the dry type developer is passed through each of the apertures or not, based on an image information of the image to be recorded on the recording medium.

2. Description of Related Art

Conventionally, as image recording methods, an electrophotographic method and an electrostatic recording method are generally used in an image recording apparatus such as a copy machine, a printer, etc.. And various dry type developers (toner) are used in a field of these recording methods.

Here, in the electrophotographic method using the dry type developer, a latent image is electrostatically formed on a photosensitive member composed of photoconductive material and the latent image is developed into a visible image by the dry type developer. Thereafter, the visible image itself is fixed on a recording medium by heating and pressing thereof.

The toner used in such recording method is classified into two types of the toners; one type belongs to the one component system in which the image is developed by only coloring particles including a resin component and a pigment, and the other type belongs to the two components system in which the image is developed by particles such as ferrite, glass bead and the coloring particles used in the above one component system.

The image recording apparatus utilizing the electrophotographic method or the electrostatic recording method is very complex and there is a limit in high resolution of the image if using the toner produced by a comminution method. Because, when the image is recorded on the recording medium so as to reproduce fine lines by using the atomized toner, the minimum particle size (particle diameter) of the toner produced by the comminution method is about 7 μm at best and further it is almost impossible to obtain more finer toners than 7 μm so long as using the comminution method.

On the other hand, a method for producing the toner by polimerization without using the comminution method is proposed. For example, such method is disclosed in Japanese Patent Application Laid Open No.s 57-102,666, 63-304,002. Though, by using such disclosed method, it can be produced the toner particles finer than 7 μm by polimerization and thereby be realized the high resolution of the image, the polimerized toner articles are tend to adhere to the photosensitive member composed of the photoconductive material in the electrophotographic apparatus, as a result, cleaning of the photosensitive member cannot be effectively conducted because the adhered toner articles are not easily taken away from the photosensitive member, if the polimerized toner articles are utilized in a developing process of the electrophotographic apparatus.

Therefore, methods in which the image is recorded on the recording medium without using the photosensitive member are variously proposed, and in such proposed methods, the method disclosed in U.S. Pat. No. 3,689,935 is well-known. In such method, an image recording apparatus having a control means which comprises an aperture electrode, the aperture electrode being constructed by forming a plurality of apertures in a straight line through an electrode plate including two electrodes formed on opposite sides of an insulating layer, is utilized. And the image is recorded on the recording medium arranged opposite to the aperture electrode by controlling whether the toner provided from a toner providing device is passed through each of the apertures.

However, in the image recording apparatus disclosed in U.S. Pat. No. 3,689,935, quality of the recorded image is extremely affected by particle size distribution of the toner. Here, in order to appreciate the particle size distribution, a ratio both the average particle size calculated based on particle volume (abbreviated APSV hereinafter) and the average particle size calculated based on particle number (abbreviated APSN hereinafter) is generally calculated. And if the ratio of APSV and APSN is bigger than a predetermined value, the particle size of the toner is ununiformly distributed and thereby, the toner cannot be uniformly charged. On the other hand, if the ratio of APSV and APSN is smaller than a predetermined value the particle size of the toner is uniformly distributed and thereby, the toner can be uniformly charged.

Therefore, in case that the toner having the ratio of APSV and APSN, which is bigger than the predetermined value, is used in the image recording apparatus mentioned above, concentration of the toner passing through the apertures in the aperture electrode is made ununiform and thus, the image is ununiformly recorded on the recording medium. Further, there are problems that the toner is passed through the apertures in the aperture electrode, through which the toner must not pass and that the apertures are blinded by the toner because the toner is charged ununiformly.

SUMMARY OF THE INVENTION

Accordingly, it is an object of the present invention to overcome the above mentioned problems and to provide a dry type developer utilized in an image recording apparatus, so that the developer can be stably and uniformly provided to a control device of the image recording apparatus, and thereby, the image without ununiformity can be obtained.

To accomplish the object, the present invention comprises a dry type developer including colored particles which are flown to a recording medium, thereby an image being recorded on the recording medium, wherein, a ratio of both an average particle size of the particles calculated based on volume of the particle and an average particle size of the particles calculated based on number of the particle, lies in a range of from 1.00 to 1.35.

According to the present invention, the distribution of the particle size in the toner can be made sharp with mono-dispersion, thereby uniform charge quantity can be obtained without being affected by change in the charge quantity changed according to the toner particle size, because the toner particle size can be made uniform. Therefore, the image with stable and uniform concentration can be recorded on the recording medium all the time. As a result, the image with fine line can be clearly recorded on the recording medium with high resolution.

The above and further objects and novel features of the present invention will be more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The invention will be described with reference to the following drawings, wherein.

DETAILED DESCRIPTION OF THE PREFERRED EMBODIMENTS

A detailed description of the preferred embodiment will now be given referring to the accompanying drawings. At first, an image recording apparatus in which a dry type developer of the present invention is utilized, will be described hereinafter.

Figure 1:
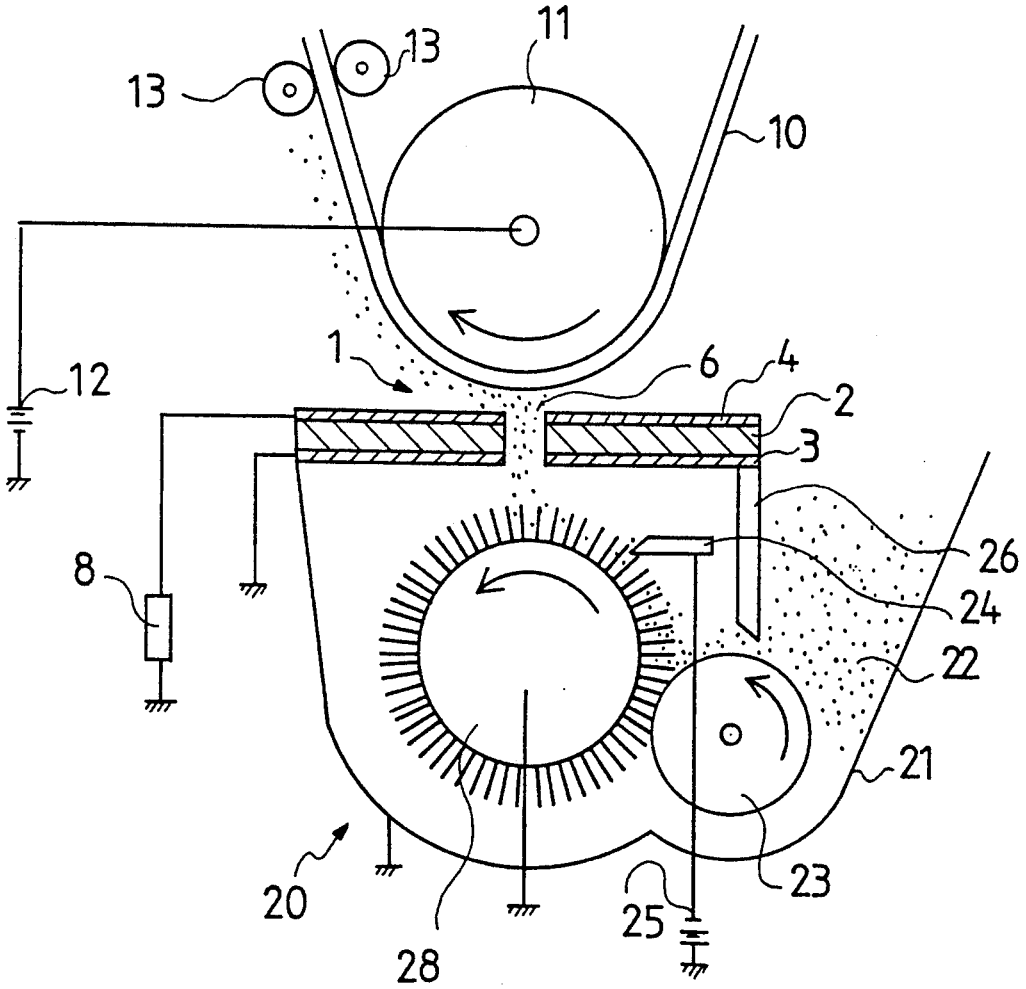
FIG. 1 is a schematic view showing an image recording apparatus in which a dry type developer of the present invention is used.

In FIG. 1, an aperture electrode 1 is arranged between a toner providing device 20 and a rear electrode 11. The aperture electrode 1 has a three-layered construction in which a reference electrode 3 facing to the toner providing device 20 and a control electrode 4 facing to the rear electrode 11, are formed on opposite sides of an insulator 2. As shown in FIG. 1, at the side of the reference electrode 3 (at the lower side of the aperture electrode 1), the toner providing device 20 is arranged and at the side of the control electrode 4 (at the upper side of the aperture electrode 1), the rear electrode 11 supporting a recording medium 10 thereon is arranged.

Figure 2:
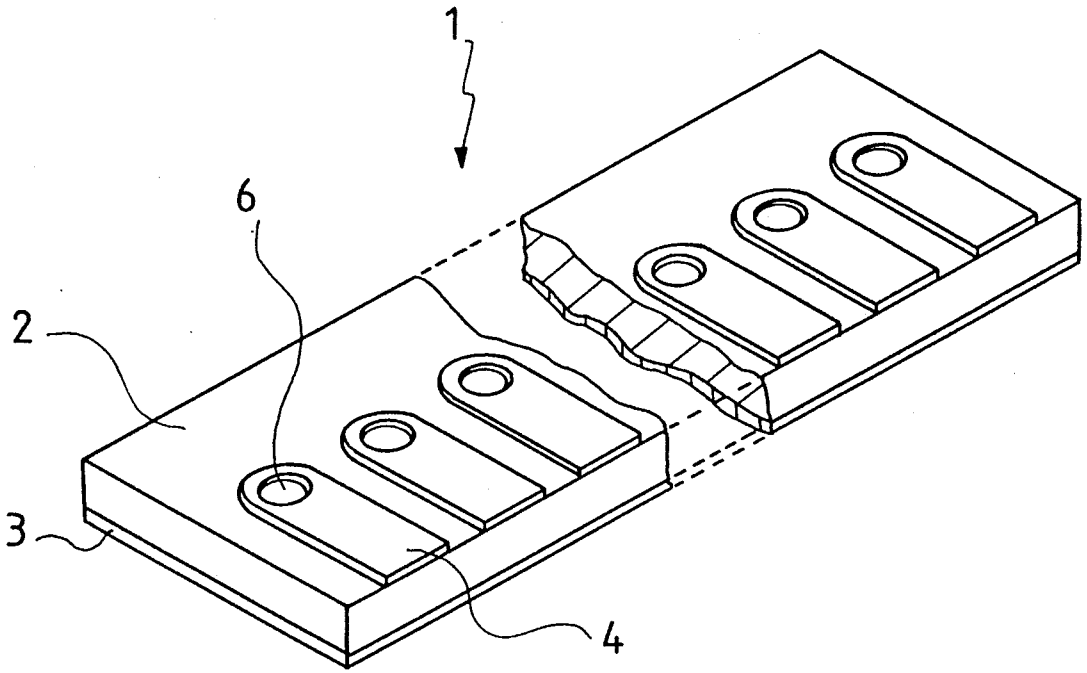
FIG. 2 is a perspective view of an aperture electrode installed in the image recording apparatus shown in FIG. 1.

Here, the aperture electrode 1 will be described referring to FIG. 2. In FIG. 2, on the upper side of the aperture electrode 1, a plurality of the control electrodes 4 are formed with a predetermined distance therebetween and at each inner end of the control electrode 4, an aperture 6 is formed so as to penetrate the control electrode 4, the insulator 2 and the reference electrode 3. Each aperture 6 is ordered in a straight line and as mentioned hereinafter, toner 22 is passed through each aperture 6 from the toner providing device 20 to the recording medium 10 supported on the rear electrode 11. And on the lower side of the aperture electrode 1, the reference electrode 3 is formed so as to cover the entire surface of the insulator 2.

In the toner providing device 20 arranged at the side of the reference electrode 3, both a brush roller 28 and a toner providing roller 23 parallel with the brush roller 28 are rotatably arranged in a toner case 21 in which toner 22 is stored. The brush roller 28 and the toner providing roller 23 are mutually rotated with contact each other. And a restriction blade 26 is arranged at an upper position of the toner providing roller 23 so that quantity of the toner 22 provided from the toner case 21 is restricted to a suitable quantity. Further, at a right upper position (in FIG. 1) of the brush roller 28 where the brush of the brush roller 28 retaining the toner 22 provided from the toner providing roller 23 reaches before reaching near the aperture 6, a scratching blade 24 is arranged so as to contact the brush of the brush roller 28. The scratching blade 24 is made of metal material and top portion of the blade 24 is processed into a sharp figure, and moreover, the scratching blade 24 is connected to a negative high voltage source 25. Here, the reference electrode 3, the brush roller 28 and the toner case 21 are grounded to earth.

And at the side of the control electrode 4 on the aperture electrode 1, it is arranged the cylindrical rear electrode 11 which is rotated while supporting the recording medium 10 thereon. The rear electrode 11 is connected to a positive high voltage source 12. The recording medium 10 is forwarded according to rotation of the rear electrode 11 and at a down stream position in a forwarding direction of the recording medium 10, a fixing device 13 is arranged. The fixing device 13 fixes the toner 22 transferred onto the recording medium 10. And further, each of the control electrodes 4 are connected to a control circuit 8 which selectively provides a voltage for each control electrode 4 based on image signals input form an external device.

Next, the dry type developer utilized in such constructed image recording apparatus, will be described hereinafter. The toner 22 as the dry type developer is able to be produced by the comminution method mentioned above, a spray drying method and a polymerizing method.

First, the method for producing the toner 22 by the comminution method will be described. In the comminution method, the same process in the conventional toner producing method is taken till the comminution process is finished.

Raw materials of the toner are mixed in a mixer and mixture in which the raw materials are uniformly mixed, is formed. And the mixture is heated and melted in a kneader, thereby fine particles having no compatibility each other are obtained. After kneading by the kneader, the raw materials of the toner in the form of fine particles are cooled down by a cooling roller. Thereafter, the raw materials are formed into particles with particle size of 1–2 mm by a rough grinder such as a cutter mill and they are ground into fine particles with average particle size (diameter) of 20 μm by a fine grinder. Here, at this stage, particle size of the above obtained fine particles are ununiformly distributed, thus, they cannot be used as the toner in the image recording apparatus because of large amount of fine dust particles. Therefore, the fine particles ground through the fine grinder are processed twice in classification process, as a result, the fine particles, the particle size distribution of which is made sharp with mono-dispersion, are obtained.

Concerning with binding agent (resin) used in the toner produced by the above comminution method, binder for the ordinary toner is able to widely use. For instance, it can be used one or more kinds of resins selected from a group consisting of: mono-polymer such as polystyrene, polyvinyl toluene; styrene copolymers such as styrene-parachloro styrene copolymers, styrene-acrylic butylate, styrene-methyl methacrylate copolymers, styrene-maleic acid copolymers; the other polymer such as polymethyl methacrylate, polyvinyl chloride, polyethylene, polypropylene, polyester, epoxy resin, terpene resin, phenol resin.

And concerning with colorant used in the toner of the embodiment, it can be used pigment such as carbon black, iron powder, or dye such as nigrosine, benzidine yellow, quinacridone, rhodamine B, phthalocyanine blue. Further, charge control agent and/or lubricant may be mixed in the toner, if necessary. Here, as the charge control agent, dye including metal or nigrosine is used and as the lubricant, wax or hydrophobic colloidal silica is used.

Next, in case that the toner is produced through the spray drying method, both the toner binder and the colorant used in the comminution method is able to use. Thus, the toner binder is dissolved in the solvent while dispersing the colorant therein and thereafter spray drying of such mixture is conducted in high temperature or low temperature atmosphere through a spray drier. Thereby, spherical particles of the toner are produced. The spherical particles are classified into a virgin toner having the sharp distribution of the particle diameter (particle size), through the classification process. And the toner is obtained by adding the hydrophobic colloidal silica.

Further, in case that the toner is produced through the polymerization method, it will be desirable that the particles obtained by dispersing or suspending the mono-polymer with vinyl group in the liquid solvent having non-compatibility against the mono-polymer, are used. And surface of the particle obtained according to the above, is coated with the pigment or the dye.

Here, it may be used method in which the toner particles are produced by mixing polymerizable monomer and the pigment or the dye simultaneously and polymerizing the monomer or method in which the polymerized particles are colored by the dye after polymerization.

Next, the polymerization of the toner particles will be described hereinafter. In the polymerization method, the polymerizable monomer is dispersed in the solvent after dispersant is dispersed therein and thereafter, the polymerizable monomer is initiated to polymerize by initiator. In addition to this, the solvent, the dispersant, the polymerizable monomer and the initiator will be described.

As the organic solvent utilizable in the polymerization method, it can be used: ketone such as acetone, cyclohexane; ether alcohol such as ethylene glycol, propylene glycol; alcohol such as methanol, ethanol, isopropanol, hexanol-propylene glycol. Here, in addition to the organic solvent, water can be used, and the water or the organic solvent is used independently or used by mixing two or more kinds thereof.

As the dispersant, it can be used, for example,: fiber resin such as hydroxy ethylcellulose, hydroxy butylcellulose; polyvinyl alcohol resin such as polyvinyl acetate, ethylene-vinyl alcohol copolymers; the other resin such as polyvinyl pyrrolidone, poly acrylic acid-polyvinyl methylether.

As the polymerizable monomer, it can be used: acrylic acid monomer such as methyl acrylate, methyl methacrylate; styrene monomer such as styrene, vinyl toluene; alcohol monomer allyl alcohol, methallyl alcohol; vinyl monomer such as vinyl acetate, vinyl chloride. The polymerizable monomer may be used by mixing one or more kinds thereof.

Here, polymerization of the polymerizable monomer is initiated by the initiator such as; peroxide constituting of benzoyl peroxide, di-t-butyl peroxide; azo compound constituting of azobisisobutyronitrile, 2,2'-azobis (2,4-dimethyl valeronitrile).

As the colorant which is utilized for coloring the polymerized particles or shooting the pigment or the dye to the polymerized particles, the dye and the pigment used in the comminution method may be utilizable. Here, in coloring by the dye or the pigment, the polimerized particles are colored in the organic solvent or the water in which the dye or the pigment is dispersed. And in coloring by shooting the dye or the pigment, the dye or the pigment is added to the polymerized particles and thereafter, the surfaces of the particles are colored by a surface reformer such as HYBRIDIZATION (produced by Nara Machinery Co. Ltd.) or MECHANOFUSION (produced by Hosokawa Micron Co. Ltd). And the hydrophobic colloidal silica or similar fluid modifier is added to the colored particles, thereby the obtained colored particles are used as the dry type developer.

Further, in case that coloring is conducted simultaneously with polymerization of the particles, the dye or the pigment used in the comminution method is utilizable. In this case, the dye or the pigment is dispersed in the solvent simultaneously with dispersion of the polimerizable monomer and the dye or the pigment is retained in the polymerized particles, thereby the particles are colored by the dye or the pigment. Moreover, fluid modifier such as the hydrophobic colloidal silica is added to the colored particles and the obtained colored particles are used as the dry type developer.

Next, operation of the image recording apparatus shown in FIGS. 1 and 2, which utilizes the toner obtained according to the above, will be described.

In FIG. 1, the toner 22 is maintained by the brush of the brush roller 28 according to rotation of the brush roller 28 and the toner providing roller 23. At this time, quantity of the toner 22 maintained by the brush is restricted by the restriction blade 26. The toner 22 is fed toward the scratching blade 24 according to rotation of the brush roller 28. Here, electric field is formed between the scratching blade 24 and the brush roller 28 grounded to earth since high voltage is applied to the scratching blade 24 through the negative high voltage source 25. Therefore, negative charged ion ionized by the strong electric field formed near the scratching blade 24 is coupled to the toner 22 on the way to the brush roller 28 and thus, the toner 22 is strongly charged. And the toner 22 is forcedly charged by the electric field formed between the scratching blade 24 and the brush roller 28 and further, the toner 22 is frictionally charged both between the toner 22 and the toner providing roller 23 and between the toner 22 and the brush roller 28. As a result, charge quantity is made large.

Here, the scratching blade 24 has one more function so as to flip the brush of the brush roller 28. When the brush is flung by the scratching blade 24, the charged toner 22 retained in the brush is drifted in the air from the brush. By this operation of the scratching blade 24, cloudy state of the toner 22 is continuously formed near the aperture electrode 1.

On the other hand, the recording medium 10 supported on the rear electrode 11 is fed between the control electrode 4 and the rear electrode 11 according to rotation of the rear electrode 11. Corresponding to feeding of the recording medium 10, positive voltage is selectively applied to the control electrode 4 according to the image signals transmitted from the control circuit 8, thereby electric potential gradient is formed in the aperture 6 from the reference electrode 3 toward the control electrode 4. As a result, the negative charged toner 22 flung by the scratching blade 24 is passed through the aperture 6 from the toner cloud and further, is flown to the recording medium 10. At this time, since positive high voltage is applied to the rear electrode 11 from the positive high voltage source 12, the negative charged toner 22 is led toward the recording medium 10 and further adhered thereto on the basis of the electrostatic power of the toner 22.

Here, the control electrode 4 to which the image signal is not transmitted from the control circuit 8, is grounded to earth or is made negative potential, and therefore, the toner 22 is not passed through the aperture 6 corresponding to such control electrode 4.

The recording medium 10 on which the toner image is formed, is fed to the fixing device 13 by the rear electrode 11 and the toner image is fixed firmly on the recording medium 10 by the fixing device 13.

In the above embodiment, though the negative charged toner 22 is utilized, the positive charged toner 22 can be utilized if the negative voltage is applied to the control electrode 4.

Next, examples of the toner 22 which is utilizable in the above image recording apparatus, will be described. Here, the APSV and the APSN of the toner 22 is calculated based on the particle size distribution obtained from a coulter counter and the ratio of the APSV and APSN is also calculated based thereon.

EXAMPLES

Example 1

Mixture composed of styrene-butyl acrylate copolymers of 100 weight parts, carbon black of 10 weight parts, charge control agent of 2 weight parts, was melted and kneaded. After cooled down, the mixture was ground by an air-jet type grinder and passed twice the classification process. Thereby, the virgin toner was obtained. And the hydrophobic colloidal silica of 0.5 wt. % is added to the above obtained virgin toner, as a result, the dry type developer was obtained.

The APSV of the developer was 9.5 μm and the ratio of the APSV and APSN (APSV:APSN) was 1.28. And the image recording was conducted by using the dry type developer in the image recording apparatus mentioned above. As a result, unnecessary splash of the developer and blinding of the aperture 6 in the aperture electrode 1 did not occur. Concentration of the recorded image was 1.5 when measured by the MACBETH densitometer.

Example 2

While mixing and dispersing mixture composed of methyl methacrylate monomer of 100 weight parts, polyvinyl alcohol (as water dispersant) of 5 weight parts and benzoyl peroxide of 2 weight parts in water of 500 weight parts, heat polymerization was conducted for 20 hours at temperature of 80° C. Thereby, particles with the APSV of 7 μm was obtained. And after centrifugation of the polymerized particles by the centrifugal separator, precipitate was washed by alcohol, left alone and dried. Thereby, basic particles of the developer was obtained.

Further, after mixing and stirring mixture composed of the basic particles of 100 weight parts, carbon black of 5 weight parts and charge control agent of 0.5 weight parts by mixer, the mixture was processed by the surface reformer (HYBRIDIZATION) for three minutes under 7,000 rpm (rotation per minute). Thus, such mixture was fixed on the surfaces of the particles. Further, the hydrophobic colloidal silica of 0.5 wt. % was added to the colored particles by the carbon black. As a result, the dry type developer was obtained.

The APSV of the developer was 7.2 μm and the ratio of the APSV and APSN (APSV:APSN) was 1.18. And the image recording was conducted by using the dry type developer in the image recording apparatus mentioned above. Concentration of the recorded image was 1.5 when measured by the MACBETH densitometer. And the image with sharp edge could be obtained without blinding of the aperture 6 in the aperture electrode 1.

Example 3

Isopropanol of 500 weight parts was poured in a flask and poylvinyl pyrrolidone was added while slowly dissolving in isopropanol. After heating such solution to 70° C., styrene monomer of 30 weight parts, butyl acrylate of 5 weight parts and azobisisobutyronitrile of 1 weight part were mixed in the flask and heat polymerization was continued for 20 hours while stirring. Thereafter, polymerized product was centrifuged and supernatant liquid was removed. Remaining precipitate was washed by methanol and centrifuged again. Further, after methanol was removed therefrom, the precipitate was left alone. Obtained white powder of 10 weight parts was mixed and dispersed in methanol of 300 weight parts while stirring, and after oil black of 2 weight parts was dissolved and mixed for 1 hour, the powder was centrifuged and left alone. As a result, colored and dried particles were obtained. And after mixing the colored particles of 100 weight parts with the hydrophobic colloidal silica of 0.5 weight parts by the mixer, the colored particles of the developer was obtained.

The APSV of the developer was 5.3 μm and the ratio of the APSV and APSN (APSV:APSN) was 1.15. And the image recording was conducted by using the dry type developer in the image recording apparatus mentioned above. Concentration of the recorded image was 1.3 when measured by the MACBETH densitometer.

Example 4

Polyester resin of 100 weight parts was dissolved in toluene of 300 weight parts and slurry in which carbon black of 12 weight parts and charge control agent of 3 weight parts were dispersed, was produced by using homogenizer. And the slurry was sprayed in atmosphere of nitrogen under condition of entrance temperature at 100° C.–110° C. and exit temperature at 40° C.–50° C., thereby spherical colored particles were obtained.

The particle size distribution of the colored particles obtained was in a wide range of 1 μm–80 μm and thus, fluidity thereof was very poor as the dry type developer and charge quantity became very large. Therefore, the colored particles were processed through the classifier and as a result, the particle size distribution thereof was made in a range of 7 μm–20 μm. Thereafter, the hydrophobic colloidal silica of 0.5 wt. % was added to the colored particles of 100 weight parts, thereby the dry type developer was obtained.

The APSV of the developer was 12 μm and the ratio of the APSV and APSN (APSV:APSN) was 1.27. And the image recording was conducted by using the dry type developer in the image recording apparatus mentioned above. Concentration of the recorded image was 1.5 when measured by the MACBETH densitometer.

Example 5

Polyvinyl pyrrolidone of 10 weight parts was added to ethanol of 500 weight parts and dissolved in ethanol by slow stirring. And styrene monomer of 80 weight parts, methyl methacrylate monomer of 20 weight parts, azobiscyclohexanenitrile of 5 weight parts, benzoyl peroxide of 2 weight parts and dye including metal of 6 weight parts (VALLIFAST YELLOW 3120 similar to C.I SOLVENT YELLOW 21 which belongs to azo dye composed of metallic complex salt, produced by Orient Chemical Co. Ltd.) were dispersed in mixture obtained according to the above and heat polymerization thereof was conducted for 20 hours at a temperature of 80° C. The polymerized product was centrifuged and yellow colored particles were obtained after supernatant liquid was removed, left alone and dried. Further, the hydrophobic colloidal silica of 0.5 wt. % was added to the yellow colored particles and thereby, the dry type developer was obtained.

The APSV of the developer was 6.6 μm and the ratio of the APSV and APSN (APSV:APSN) was 1.21. And the image recording was conducted by using the dry type developer in the image recording apparatus mentioned above. Yellow concentration of the recorded image was 1.1 when measured by the MACBETH densitometer.

Example 6

First, another toner was prepared by using the virgin toner obtained in the example 1, as follows. The virgin toner was processed in only one classification process. And the hydrophobic colloidal silica of 0.5 wt. % was added to the virgin toner of 100 weight parts and thereby, the another toner was obtained.

Thereafter, the virgin toner obtained in example 1 and the another toner obtained according to the above, were mixed each other so that weight ratio of the virgin toner: the another toner became 20:80. Thereby, the dry type developer was prepared. Here, the APSV thereof was 9.0 μm and the ratio of the APSV and the APSN (APSV:APSN) was 1.47. And the image recording was conducted by using the dry type developer in the image recording apparatus mentioned above. Concentration of the recorded image was 1.5 when measured by the MACBETH densitometer. Further, the image with sharp edge could be obtained without blinding of the aperture 6 in the aperture electrode 1 till the image recording was continuously conducted on 50 sheets of the recording medium 10.

Example 7

The virgin toner obtained in the example 1 and the another toner obtained in the above example 6, are mixed each other so that weight ratio of the virgin toner and the another toner became 70:30. Thereby, the dry type developer was prepared. Here, the APSV thereof was 9.3 μm and the ratio of the APSV and the APSN (APSV:APSN) was 1.33. And the image recording was conducted by using the dry type developer in the image recording apparatus mentioned above. Concentration of the recorded image was 1.5 when measured by the MACBETH densitometer. Further, the image with sharp edge could be obtained without overlapping of the image and blinding of the aperture 6 in the aperture electrode 1 till the image recording was continuously conducted on 50 sheets of the recording medium 10.

Example 8

As same in the example 5, polyvinyl pyroildone of 2 weight parts was added to ethanol of 500 weight parts while slow stirring. Thereafter, the same process in the example 5 is conducted, thereby the dry type developer was prepared. Here, the APSV thereof was 7.4 μm and the ratio of the APSV and the APSN (APSV:APSN) was 1.43. And the image recording was conducted by using the dry type developer in the image recording apparatus mentioned above. Concentration of the recorded image was 1.1 when measured by the MACBETH densitometer. Further, the image with sharp edge could be obtained without blinding of the aperture 6 in the aperture electrode 1 till the image recording was continuously conducted on 50 sheets of the recording medium 10.

COMPARATIVE EXAMPLES

Comparative Example 1

In comparative example 1, the same virgin toner as in the example 1 was used. The virgin toner was processed in only one classification process. And the hydrophobic colloidal silica of 0.5 wt. % was added to the virgin toner of 100 weight parts and thereby, the dry type developer was obtained.

In such obtained developer, the APSV of the developer was 8.8 μm and the ratio of the APSV and APSN (APSV:APSN) was 1.57. And the image recording was conducted by using the dry type developer in the image recording apparatus mentioned above.

As a result, the aperture 6 in the aperture electrode 1 was blinded by the developer and the developer adhered in the aperture 6 could not easily removed therefrom. Further, in the image recorded on the recording medium 10, concentration thereof was in a range of 0.8–1.2, therefore only the image with ununiformity was obtained.

Comparative Example 2

In the comparative example 2, the toner obtained by spraying the slurry prepared in the example 4 was used as the dry type developer, without classifying of the toner. Such dry type developer had the APSV of 17 μm and the ratio of the APSV and APSN (APSV:APSN) was 1.78. And the image recording was conducted by using the dry type developer in the image recording apparatus mentioned above. In this case, the aperture 6 in the aperture electrode 1 was immediately blinded, therefore the image could not be recorded on the recording medium 10.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A dry type developer including colored particles for use in an image recording apparatus of the type having means for supporting a recording medium thereon; developer providing means for storing the developer charged with one polarity therein; an aperture electrode comprising an insulator, a control electrode formed on one side of the insulator and an aperture penetrating the control electrode and the insulator; and a control device for selectively applying a voltage with a reverse polarity to the control electrode in response to which the charged developer is passed through the aperture and directed to a recording medium supported on the support means when a voltage is applied to the control electrode from the control device, wherein an average particle size of the particles calculated based on volume of the particle is less than 17.0 μm and a ratio of both an average particle size of the particles calculated based on volume of the particle and an average particle size of the particles calculated based on number of the particle, lies in a range of from 1.00 to 1.50.

2. The dry type developer according to claim 1, wherein the ratio lies in a range of from 1.10 to 1.30.

3. The dry type developer according to claim 1, wherein the particles are produced by grinding thereof through a grinder and thereafter by processing through a classifier.

4. The dry type developer according to claim 3, wherein the particles are bound by binder and colored by colorant.

5. The dry type developer according to claim 4, wherein the binder is composed of one or more kinds of resins selected from a group consisting of: monopolymer such as polystyrene, polyvinyl toluene; styrene copolymers such as styrene-parachloro styrene copolymers, styrene-acrylic butylate copolymers, styrene-methyl methacrylate copolymers, styrene-maleic acid copolymers; polymer such as polymethyl methacrylate, polyvinyl chloride, polyethylene, polypropylene, polyester, epoxy resin, terpene resin, phenol resin.

6. The dry type developer according to claim 4, wherein the colorant is composed of: pigment such as carbon black, iron powder, or dye such as nigrosine, benzidine yellow, quinacrydone, rhodamine B, phthalocyanine blue.

7. The dry type developer according to claim 4, wherein the particles include hydrophobic colloidal silica.

8. The dry type developer according to claim 4, wherein the particles further includes charge control agent or lubricant.

9. The dry type developer according to claim 8, wherein the charge control agent is composed of dye including metal or nigrosine.

10. The dry type developer according to claim 8, wherein the lubricant is composed of wax.

11. The dry type developer according to claim 1, wherein the particles are produced by spray drying thereof through a spray drier.

12. The dry type developer according to claim 11, wherein the particles include hydrophobic colloidal silica.

13. The dry type developer according to claim 1, wherein the particles are produced by polymerizing polymerizable monomer after dispersed in solvent including dispersant.

14. The dry type developer according to claim 13, wherein the solvent is composed of organic solvent selected from a group consisting of: ketone such as acetone, cyclohexane; ether alcohol such as ethylene glycol, propylene glycol; alcohol such as methanol, ethanol, isopropanol, hexanol-propylene glycol.

15. The dry type developer according to claim 13, wherein the dispersant is composed of resin selected from a group consisting of: fiber resin such as hydroxy ethylcellulose, hydroxy butylcellulose; polyvinyl alcohol resin such as polyvinyl acetate, ethylene-vinyl alcohol copolymers; the other resin such as polyvinyl pyrrolidone, poly acrylic acid-polyvinyl methylether.

16. The dry type developer according to claim 13, wherein the polymerizable monomer is composed of one or more kinds of vinyl monomers selected from a group consisting of: acrylic acid monomer such as methyl acrylate, methyl methacrylate; styrene monomer such as styrene, vinyl toluene; alcohol monomer allyl alcohol, methallyl alcohol; vinyl monomer such as vinyl acetate, vinyl chloride.

17. The dry type developer according to claim 13, wherein polymerization of the polymerizable monomer is initiated by initiator such as peroxide constituting of benzoyl peroxide, di-t-butyl peroxide; azo compound constituting of azobisisobutyronitrile, 2,2'-azobis (2,4-dimethyl valeronitrile).

18. The dry type developer according to claim 13, wherein the particles are colored by colorant.

19. The dry type developer according to claim 18, wherein the particles further include hydrophobic colloidal silica.

20. The dry type developer in accordance with claim 1 wherein the average particle size of the particles calculated based on volume of the particle lies in a range of from 5.0 μm to 17.0 μm.

* * * * *